US008636276B2

(12) United States Patent
Fujiwara

(10) Patent No.: US 8,636,276 B2
(45) Date of Patent: Jan. 28, 2014

(54) IMAGE READING DEVICE CAPABLE OF READING SKEW SHEET

(75) Inventor: Shingo Fujiwara, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/619,769

(22) Filed: Sep. 14, 2012

(65) Prior Publication Data

US 2013/0082440 A1 Apr. 4, 2013

(30) Foreign Application Priority Data

Sep. 30, 2011 (JP) ..... 2011-216255

(51) Int. Cl.
*B65H 5/00* (2006.01)

(52) U.S. Cl.
USPC ..... 271/10.11; 271/121

(58) Field of Classification Search
USPC ..... 271/10.09, 10.1, 10.11, 121, 272, 4.08, 271/4.09, 4.1, 270
See application file for complete search history.

(56) References Cited

U.S. PATENT DOCUMENTS

| | | | | |
|---|---|---|---|---|
| 5,678,815 | A * | 10/1997 | Sheng | 271/10.13 |
| 6,888,650 | B1 | 5/2005 | Mizubata et al. | |
| 2013/0083366 | A1 | 4/2013 | Motoyama | |

FOREIGN PATENT DOCUMENTS

| | | | |
|---|---|---|---|
| JP | H05-183691 | A | 7/1993 |
| JP | H09-27888 | A | 1/1997 |
| JP | 2000-295434 | A | 10/2000 |
| JP | 2001-142263 | A | 5/2001 |
| JP | 2004-214834 | A | 7/2004 |
| JP | 2004-224500 | A | 8/2004 |
| JP | 2005-136767 | A | 5/2005 |
| JP | 2006-067329 | A | 3/2006 |
| JP | 2006-165857 | A | 6/2006 |
| JP | 2006-311293 | A | 11/2006 |
| JP | 2008-011363 | A | 1/2008 |
| JP | 2009-260998 | A | 11/2009 |
| JP | 2010-050800 | A | 3/2010 |

OTHER PUBLICATIONS

Japan Patent Office, Office Action for Japanese Patent Application No. 2011-216255 (counterpart to above-captioned patent application), mailed Sep. 10, 2013.

* cited by examiner

*Primary Examiner* — David H Bollinger
(74) *Attorney, Agent, or Firm* — Baker Botts L.L.P.

(57) ABSTRACT

An image reading device includes a sheet tray, a conveying unit, a reading unit, a detecting unit, and a control unit. The conveying unit conveys the sheet along a conveying path in a conveying direction. The reading unit reads the sheet at a reading position in a main scanning direction orthogonal to the conveying direction. The control unit controls the reading unit to start reading the sheet when the detection unit detects that a leading edge of a sheet reaches a position upstream of the reading position by a first distance. The control unit controls the reading unit to stop reading the sheet when the detection unit detects that a trailing edge of the sheet reaches a position downstream of the reading position by a second distance. The first distance and the second distance are determined according to the size of the sheet.

5 Claims, 9 Drawing Sheets

IMAGE READING DEVICE CAPABLE OF READING SKEW SHEET

CROSS REFERENCE TO RELATED APPLICATION

This application claims priority from Japanese Patent Application No. 2011-216255 filed Sep. 30, 2011. The entire content of this priority application is incorporated herein by reference.

TECHNICAL FIELD

The present invention relates to an image-reading device for continuously conveying and reading a plurality of sheets of an original.

BACKGROUND

An image-reading device known in the art is capable of reading a plurality of sheets of an original while conveying the sheets continuously. Sometimes the sheets of the original are conveyed in a skewed state. In order to read sheets of an original that are skewed without losing portions of the image, the conventional device sets a larger scanning region than the size of the original in the conveying direction and the like, requiring the device to read the original within this scanning region.

SUMMARY

A conventional technology has been proposed for setting an expanded portion for each size of original based on conveying speed or input from the user. Some conventional image-reading devices set a gap between sheets of an original conveyed continuously based on the input from the user. However, these conventional reading devices are unable to eliminate the occurrence of image loss under the following circumstances. Even when the size of the expanded portion is set based on input from the user, if the sum of the expanded portion in the trailing edge of a preceding sheet and the expanded portion in the leading edge of a succeeding sheet conveyed after the preceding sheet is set greater than, the gap between the sheets, then the scanning regions of the two sheets will overlap, resulting in image loss.

Therefore, it is an object of the present invention to provide a technology for preventing image omissions when scanning an original with an image-reading device that sets the gap between continuously conveyed sheets of an original based on the size of the original.

In view of the foregoing, it is an object of the invention to provide an image reading device. The image reading device includes a sheet tray, a conveying unit, a reading unit, a detecting unit, and a control unit. The sheet tray is configured to load a plurality of sheets each having a leading edge and a trailing edge. The conveying unit is configured to convey the sheet along a conveying path in a conveying direction. The conveying unit includes a feeding roller, a drive gear, a conveying roller, a drive transmission portion, and a drive receiving portion. The feeding roller is configured to feed the sheet upon contacting the sheet. The drive gear is configured to drive the feeding roller at a first velocity. The conveying roller is configured to convey the sheet fed by the feeding roller at a second velocity faster than the first velocity. The drive transmission portion is configured to be circularly moved together with the rotation of drive gear. The drive receiving portion is configured to be circularly moved to rotate the feeding roller and be engageable with and disengageable from the drive transmission portion. The drive receiving portion is engaged with the drive transmission portion so as to rotate the feeding roller at the first velocity when the leading edge of the sheet has not reached the conveying roller. The drive receiving portion is disengaged from the drive transmission portion so as to rotate the feeding roller at the second velocity by following a rotation of the conveying roller through a sheet when the sheet is spanning between the conveying roller and the feeding roller. A period of spanning the sheet between the conveying roller and the feed roller is dependent on a size of the sheet. The circular movement of the drive receiving portion is stopped, despite a continuous rotation of the drive transmission portion, at a timing when the trailing edge of the sheet separates from the feeding roller. The drive receiving portion catches up with and engages with the drive transmission portion due to the continuous rotation of the drive transmission portion so as to rotate the feeding roller at the first velocity. The drive transmission portion and the drive receiving portion having an angular positional relationship such that a period from the timing of stopping the drive receiving portion to a timing of the catching up determines a gap between a precedent sheet and a subsequent sheet. The reading unit is provided on the conveying path and is configured to read the sheet at a reading position in a main scanning direction orthogonal to the conveying direction. The detecting unit is configured to detect the sheet passing through a position upstream of the reading position. The control unit is configured to control the reading unit to start reading the sheet when the detection unit detects that the leading edge reaches a position upstream of the reading position by a first distance. The control unit is configured to control the reading unit to stop reading the sheet when the detection unit detects that the trailing edge reaches a position downstream of the reading position by a second distance. The first distance and the second distance are determined according to the size of the sheet.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
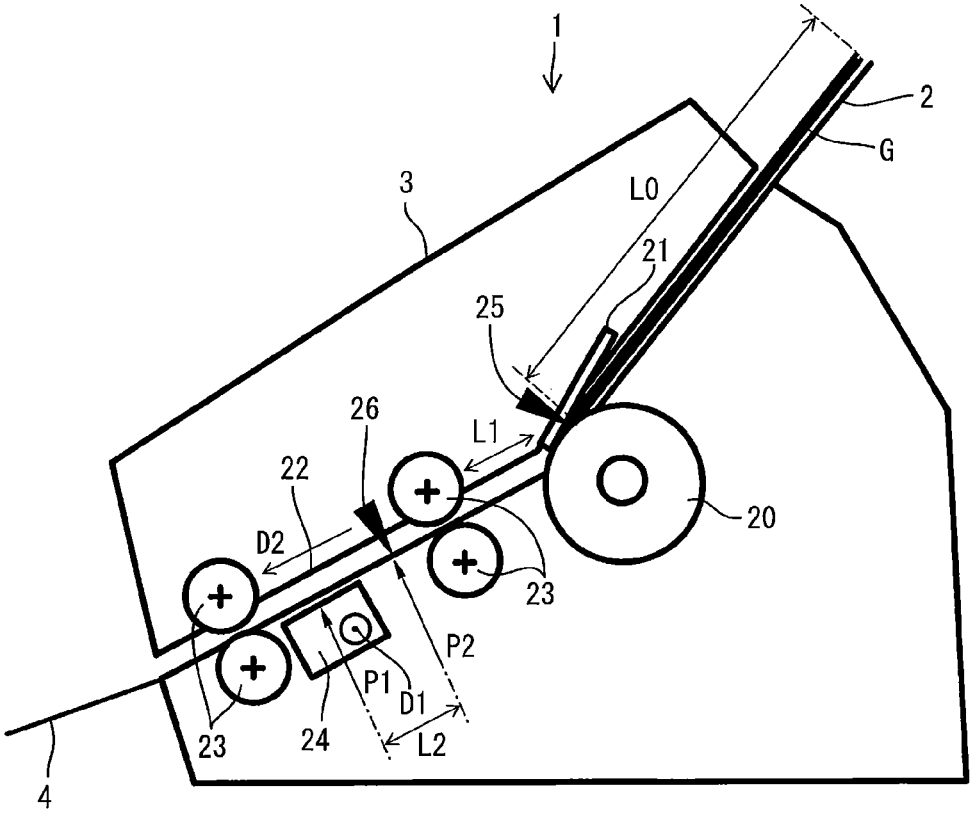
FIG. 1 is a schematic cross-sectional view showing a general structure of an image-reading device according to a preferred embodiment of the present invention.

Next, a preferred embodiment will be described while referring to FIGS. 1 through 9.

1. Mechanical Structure of an Image-Reading Device

The image-reading device 1 includes a sheet tray 2, a main body 3, and a discharge tray 4. The image-reading device 1 is a sheet-fed scanner that conveys sheets G of original loaded in the sheet tray 2 to the discharge tray 4 while reading the conveyed sheets G using a contact image sensor (CIS) 24 provided in the main body 3.

The main body 3 defines a paper-conveying path 22 linking the sheet tray 2 to the discharge tray 4. The paper-conveying path 22 has an ambient portion provided with a feeding roller 20, a separating pad 21, pairs of conveying rollers 23, the CIS 24, a front sensor 25, and a rear sensor 26.

The feeding roller 20 contacts the sheets G loaded in the sheet tray 2. When the feeding roller 20 rotates, friction is generated between the feeding roller 20 and the sheets G, by which friction the feeding roller 20 feeds the sheets into the main body 3. The separating pad 21 applies a frictional force to the sheets G in order that the feeding roller 20 can separate one sheet G from the plurality of sheets (i.e., in order to prevent multiple sheets G from being fed simultaneously). Hence, these components separate the sheets G loaded in the sheet tray 2 in order that one sheet is fed at a time into the main body 3.

Figure 5:
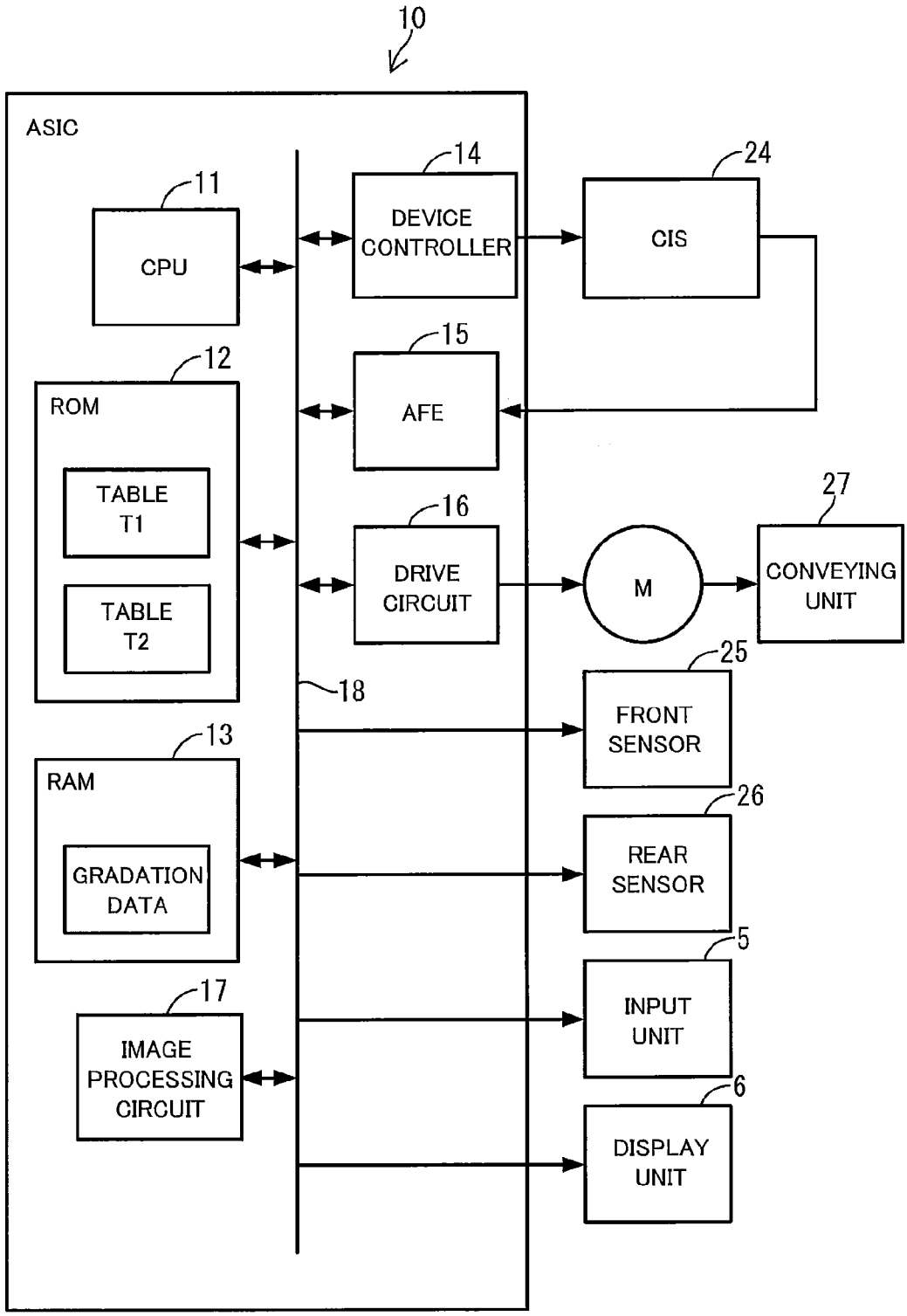
FIG. 5 is a schematic block diagram showing an electrical configuration of the image reading device according to the embodiment.

The image-reading device 1 further includes a motor M for driving the conveying rollers 23 to rotate (see FIG. 5). When driven, the conveying rollers 23 convey the sheets G that have been fed into the main body 3 along the paper-conveying path 22 in a conveying direction D2. The CIS 24 is disposed on the paper-conveying path 22 at a reading position P1 and scans the sheets G in a main scanning direction D1 orthogonal to the conveying direction D2.

The conveying rollers 23 convey the sheets G along the paper-conveying path 22 to the discharge tray 4, and the sheets are received in a stack on the discharge tray 4. Hence, the feeding roller 20 and the conveying rollers 23 constitute a conveying unit 27 that continuously conveys the sheets G loaded in the sheet tray 2 along the paper-conveying path 22.

The front sensor 25 is disposed on the sheet tray 2 and is configured to be on when a sheet G is loaded in the sheet tray 2 and to be off when a sheet G of original is not present in the sheet tray 2. The rear sensor 26 is disposed at a position P2 upstream of the CIS 24. The rear sensor 26 is configured to be on as a sheet G of original passes through the position P2 along the paper-conveying path 22 and to be off when a sheet is not present at the position P2. The main body 3 is additionally provided with an input unit 5 and a display unit 6 (see FIG. 5). The input unit 5 includes a power switch, and various buttons that receive operations and commands from the user. The display unit 6 is configured of an LED screen for displaying in the case of an LED screen the status of the image-reading device 1.

2. Mechanical Structure of the Feeding Roller

Figure 2:
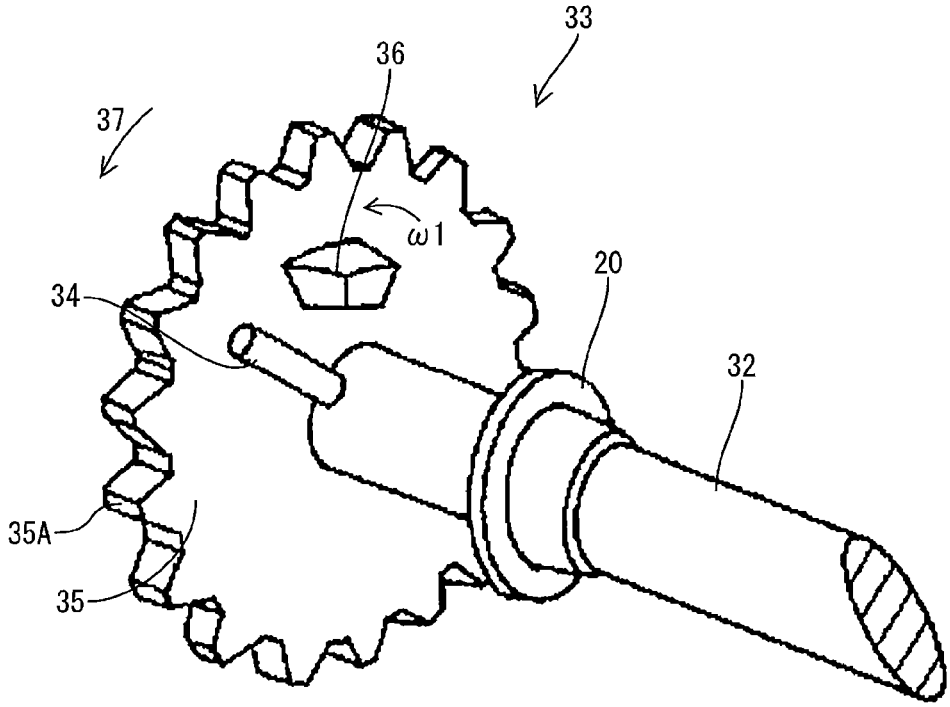
FIG. 2 is a schematic perspective view showing a driving mechanism of a feeding roller according to the embodiment.

The feeding roller 20 is driven via a drive mechanism 33 as shown in FIG. 2. The feeding roller 20 has a feeding roller shaft 32 inserted therethrough, and can rotate about the feeding roller shaft 32. A pin 34 is fixed to the feeding roller 20 and protrudes outward in a radial direction of the feeding roller shaft 32. In other words, the pin 34 is fixed to the feeding roller 20 and rotates around the feeding roller shaft 32 together with the rotation of the feeding roller 20.

A drive gear 35 is disposed adjacent to the pin 34. The feeding roller shaft 32 is inserted through the drive gear 35 so that the drive gear 35 freely rotates around the feeding roller shaft 32. The drive gear 35 includes a gear part 35A having teeth formed around its outer periphery. An external gear (not shown) engaged with the gear part 35A applies a drive force from the motor M to the gear part 35A for rotating the same at a first angular velocity ω1 around the feeding roller shaft 32 in the direction indicated by an arrow 37 in FIG. 2.

The drive gear 35A has a side surface provided with a protrusion 36 adjacent to the pin 34. The protrusion 36 is formed integrally with the drive gear 35 and rotates about the feeding roller shaft 32 together with the drive gear 35. The protrusion 36 is disposed in a position for contacting the pin 34 when the drive gear 35 is driven to rotate around the feeding roller shaft 32. The pin 34 and the protrusion 36 are capable of engaging with and separating from each other. Therefore, the feeding roller 20 and the drive gear 35 rotate together about the feeding roller shaft 32 when the pin 34 and the protrusion 36 are engaged and rotate separately about the feeding roller shaft 32 when the pin 34 and the protrusion 36 are separated.

3. Rotational Operation of the Feeding Roller

Figure 3A:
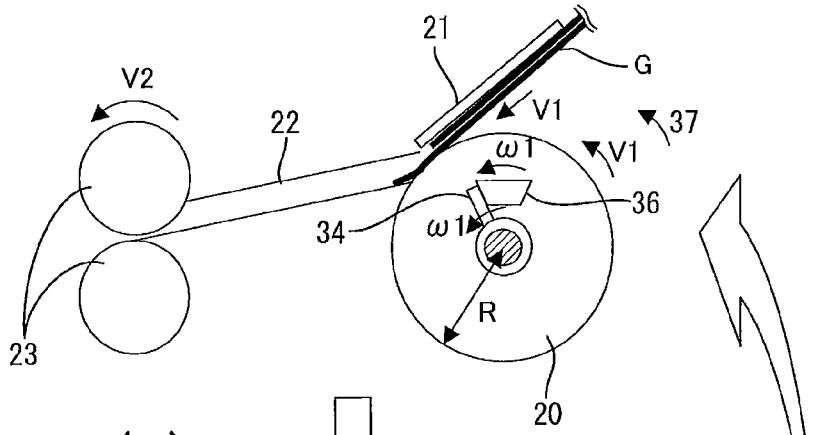
FIGS. 3 (A)-(C) are schematic diagram illustrating a sheet feeding process between the feeding roller and a conveying roller according to the embodiment.

The drive gear 35 has been omitted from FIG. 3, with only the protrusion 36 depicted. As shown in FIG. 3(A), when the image-reading device 1 first begins conveying the sheet G, the drive gear 35 is rotated at the first angular velocity ω1. The pin 34 is engaged and pressed by the protrusion 36 in the rotational direction 37 so that the feeding roller 20 also rotates at the first angular velocity ω1. As a result, the sheet G contacted by the feeding roller 20 is conveyed into the paper-conveying path 22 at a feeding velocity V1. The first angular velocity ω1 and the feeding velocity V1 have the following relationship, where R stands for the radius of the feeding roller 20.

$$V1 = R \times \omega 1$$

Figure 3B:
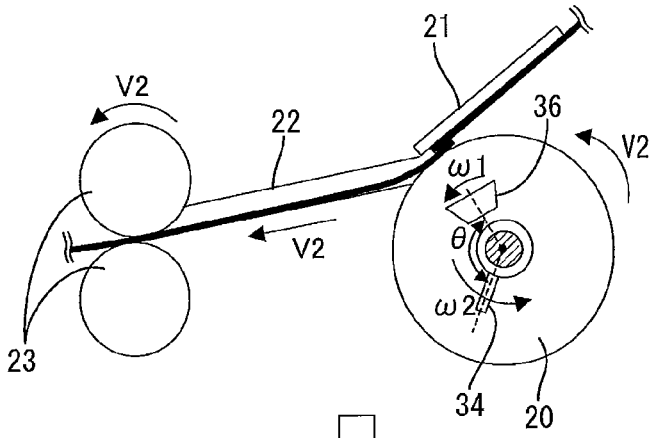

When the leading edge of a sheet G conveyed by the feeding roller 20 arrives at the conveying rollers 23, as shown in FIG. 3(B), the conveying rollers 23 begin conveying the sheet G at a conveying velocity V2, which is faster than the feeding velocity V1. Consequently, the feeding roller 20 contacting the sheet G is also rotated at the conveying velocity V2. At this time, the pin 34 begins rotating at a second angular velocity ω2 faster than the first angular velocity ω1 and then separates from the protrusion 36 rotating at the first angular velocity ω1. Upon separating the trailing edge of the sheet G from the feeding roller 20, an angle θ is produced between the pin 34 and the protrusion 36. The angle θ can be calculated from the following equation, where L0 stands for the length of the sheet G in the conveying direction D2 and L1 stands for the distance along the paper-conveying path 22 between the feeding roller 20 and the conveying rollers 23.

$$V2 > V1,\ V2 = R \times \omega 2$$

$$\theta = (\omega 2 - \omega 1) \times \frac{(L0 - L1)}{V2}$$

Figure 3C:
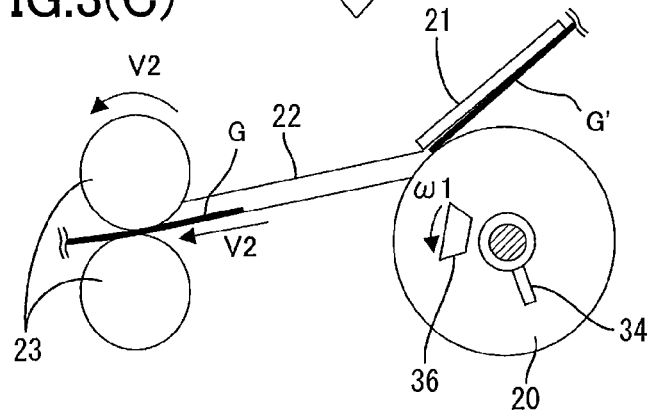

As the conveying rollers 23 continue conveying the sheet G, the trailing edge of the sheet has separated from the feeding roller 20, as shown in FIG. 3(C), and the feeding roller 20 has ceased to rotate. In the meantime, the drive gear 35 continues to rotate idly at the first angular velocity ω1 until the drive gear 35 has rotated the angle θ that was produced at the moment the feeding roller 20 came to a stop. Hence, the angle θ can be considered an idling angle over which the drive gear 35 rotates idly while the feeding roller 20 is halted. After the drive gear 35 rotates the angle θ, the protrusion 36 on the drive gear 35 once again engages the pin 34 and begins conveying the next sheet G' of original, as shown in FIG. 3(A). A gap Z formed between the trailing edge of the sheet G and the leading edge of the next sheet G' in the conveying direction D2 when the feeding roller 20 begins conveying the next sheet G' is represented by the following equation.

$$Z = V2 \times \frac{\theta}{\omega 1} = (\omega 2 - \omega 1) \times \frac{(L0 - L1)}{\omega 1}$$

Figure 4:
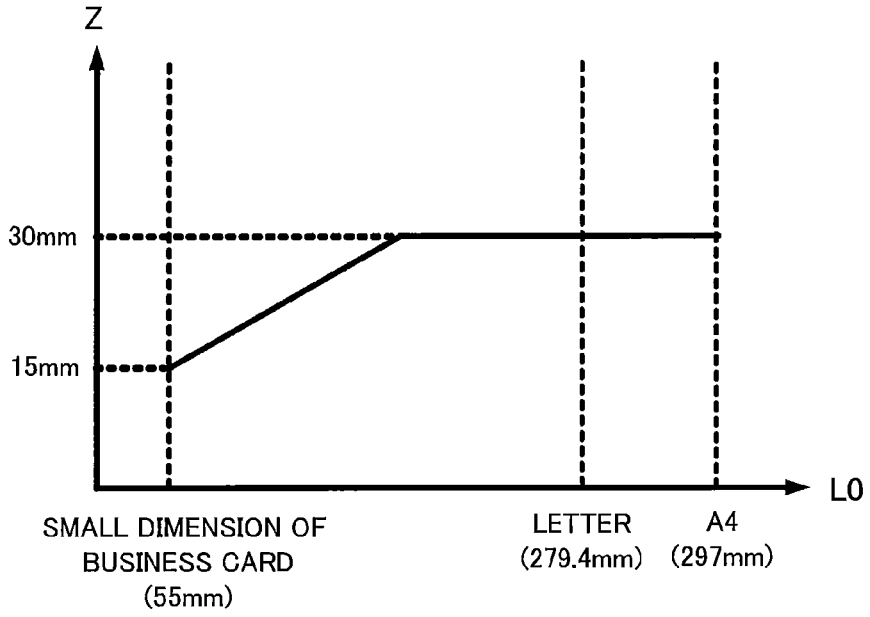
FIG. 4 is a graph showing a relationship between a size of original and a gap between sheets according to the embodiment.

In the preferred embodiment, the image-reading device 1 is capable of setting the gap Z between sheets of the original based on a size L0 of original and proportional to the distance (L0−L1). As shown in FIG. 4, as the size L0 increases from 55 mm, which is the small dimension of a business card, the image-reading device 1 increases the gap Z between sheets of the original from 15 mm up to a maximum of 30 mm. The idling angle θ is approximately 360 degrees when the gap Z between sheets of the original is 30 mm. Therefore, the image-reading device 1 maintains the gap Z between sheets of the original fixed at 30 mm, even as the size L0 grows larger. Thus, the image-reading device 1 can set the gap Z between sheets of the original based on the size L0 and the difference between the feeding velocity V1 and the conveying velocity V2. To achieve this, a CPU 11 described later need not identify the size L0 in order to set the gap Z between sheets of the original prior to conveying the sheet G.

4. Electrical Structure of the Image-Reading Device

As shown in FIG. 5, the image-reading device 1 includes an application-specific integrated circuit (ASIC) 10 that controls the components of the image-reading device 1. The ASIC 10 includes a central processing unit (CPU) 11, a ROM 12, a RAM 13, a device controller 14, an analog frontend (AFE) 15, a drive circuit 16, and an image-processing circuit 17. The front sensor 25, rear sensor 26, and the like are connected to these components via a bus 18.

The ROM 12 stores various programs for controlling operations of the image-reading device 1. The CPU 11 controls the components of the image-reading device 1 based on programs read from the ROM 12. The device controller 14 is connected to the CIS 24 and transmits signals to the CIS 24 for controlling a scanning operation based on commands received from the CPU 11. The CIS 24 reads the sheet G over a scanning region H (see FIG. 8) based on the signals received from the device controller 14 and outputs the scan data to the AFE 15.

The AFE 15 is connected to the CIS 24 and functions to convert scan data outputted from the CIS 24 as an analog signal into gradation data as a digital signal based on commands from the CPU 11. The AFE 15 stores the scan data and gradation data in the RAM 13 via the bus 18. The image-processing circuit 17 performs a skew correction process on the gradation data stored in the AFE 15 to produce corrected data.

The drive circuit 16 is connected to the motor M and transmits a pulse signal to the motor M in response to commands from the CPU 11. The drive circuit 16 drives the motor M to rotate a prescribed angle, which will be considered "one step," for each pulse in the pulse signal. When the motor M is driven one step worth, the conveying rollers 23 are driven to convey the sheet exactly a prescribed distance along the paper-conveying path 22. To convey a sheet G of original, the CPU 11 transmits a pulse signal to the motor M via the drive circuit 16, and the conveying unit 27 conveys the sheet exactly a distance corresponding to the number of pulses in the pulse signal. Hereinafter, the number of pulses in the pulse signal transmitted from the drive circuit 16 to the motor M will be referred to as the "step number."

5. Reading Process

Figure 6:
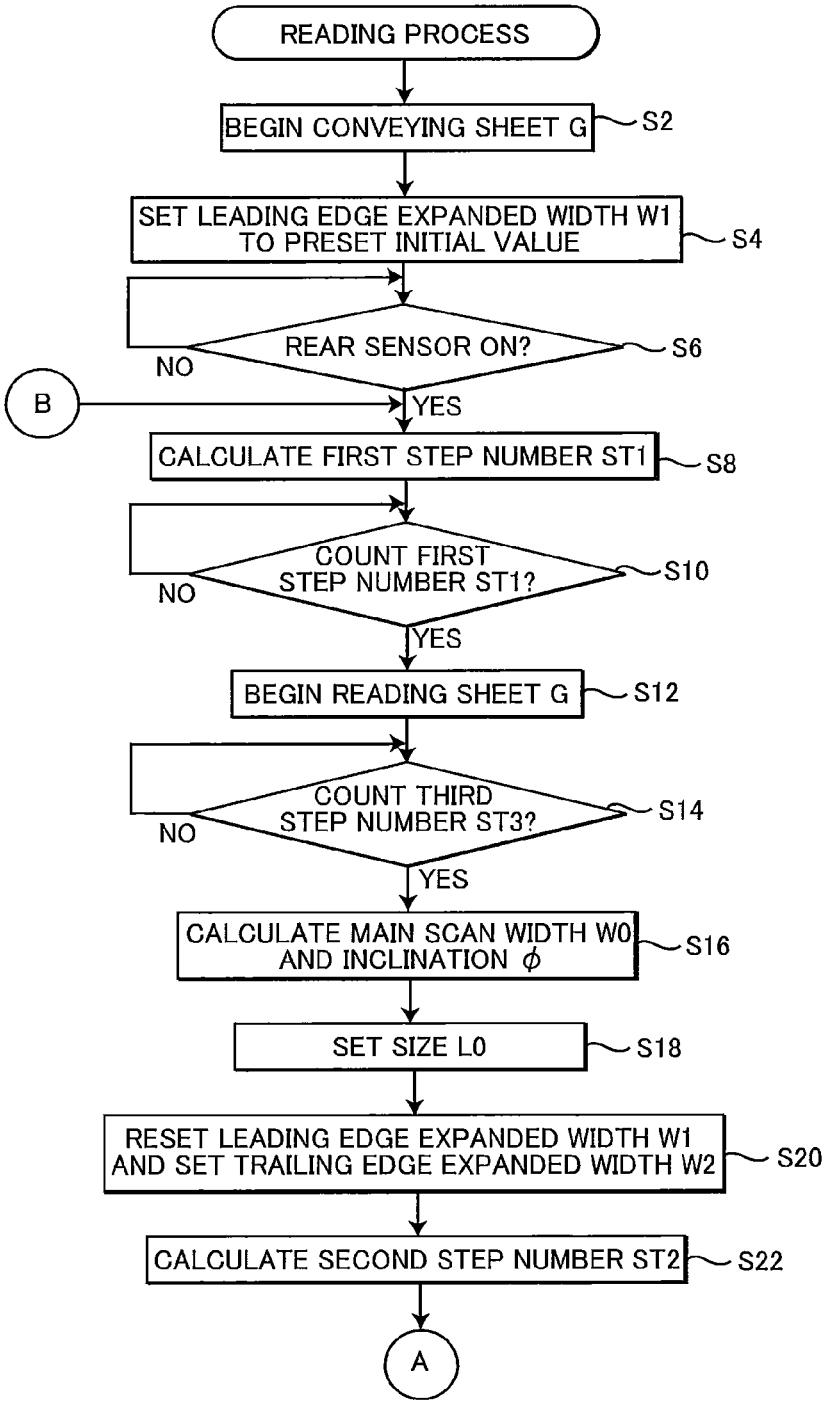
FIG. 6 is a flowchart showing a reading process according to the embodiment.
Figure 7:
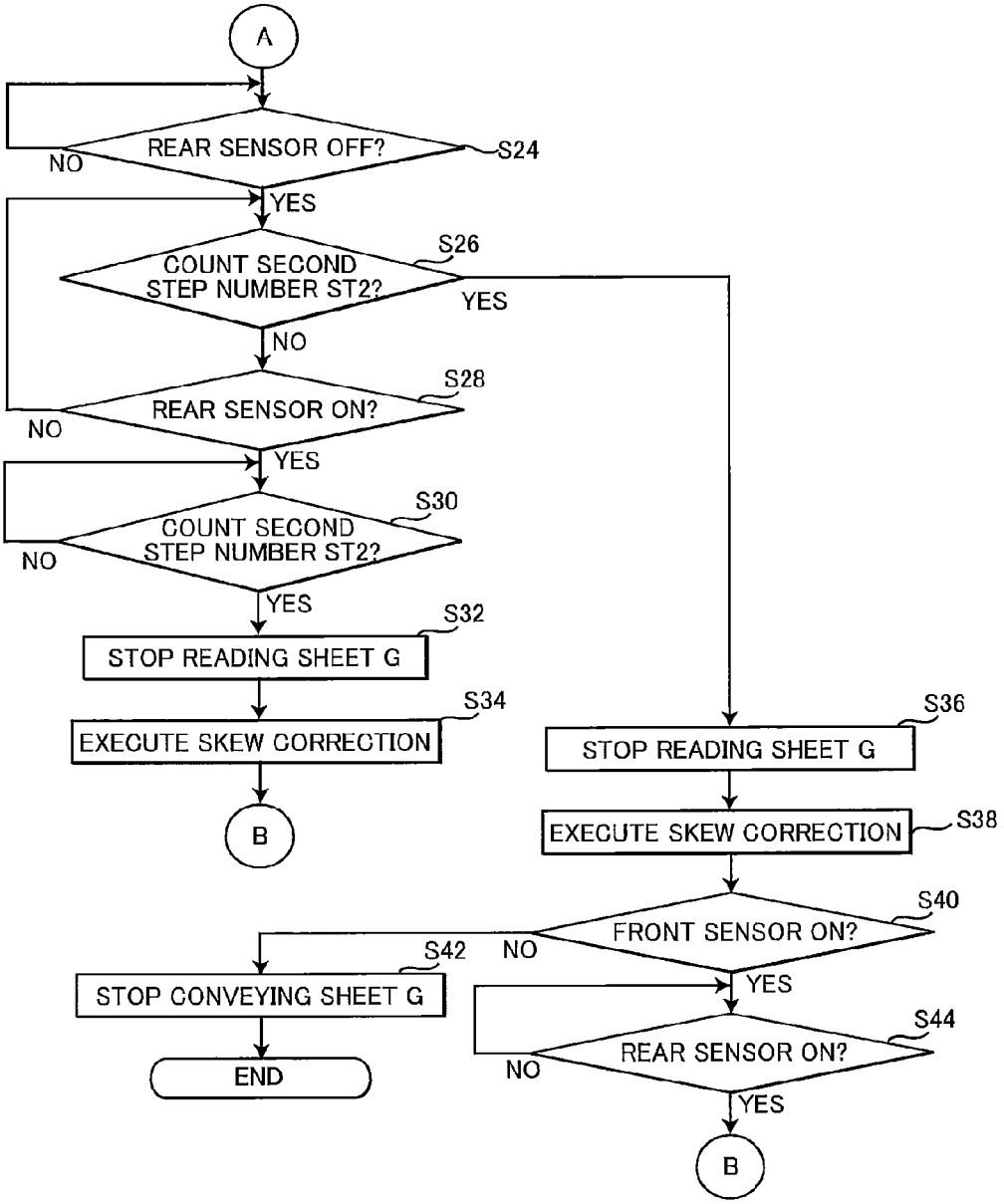
FIG. 7 is a flowchart showing the reading process succeeding FIG. 6 according to the embodiment.

Next, a process performed by the CPU 11 for using the CIS 24 to read a sheet G of original will be described with reference to FIGS. 6 through 8.

The CPU 11 begins the reading process after confirming the front sensor 25 that a sheet G of original is set in the sheet tray 2 and after a read command for reading the sheet G has been inputted on the input unit 5.

In S2 at the beginning of the reading process, the CPU 11 controls the drive circuit 16 to transmit a pulse signal to the motor M and begins counting the number of steps as the conveying unit 27 begins conveying a sheet G. After conveyance of the sheet G is initiated, in S4 the CPU 11 sets a leading edge expanded width W1 to a preset initial value.

Figure 8:
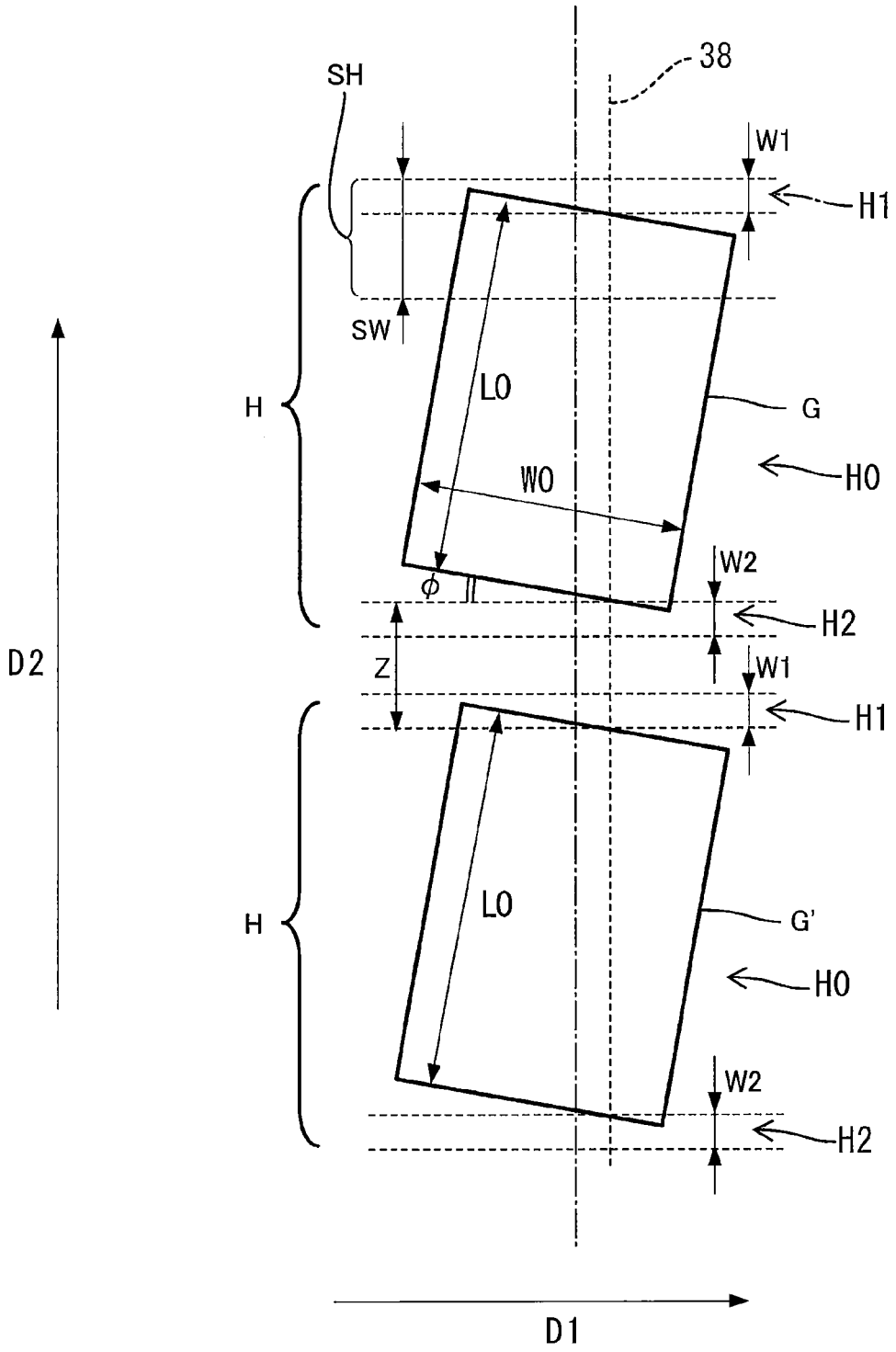
FIG. 8 is a schematic diagram explaining a scanning region and a sheet of original according to an embodiment.

As shown in FIG. 8, the leading edge expanded width W1 denotes the width in the conveying direction D2 of a region H1 within the scanning region H that the CIS 24 reads prior to the leading edge of the sheet G arriving at the reading position P1. As will be described later, a trailing edge expanded width W2 denotes the width in the conveying direction D2 of a region H2 within the scanning region H that the CIS 24 continues to read after the trailing edge of the sheet G has passed over the reading position P1.

The positions of the leading edge expanded width W1, the trailing edge expanded width W2, and the gap Z between sheets of the original with respect to the main scanning direction D1 of the scanning region H are set based on a rear sensor axis 38 along which the rear sensor 26 detects the sheets G. By including the regions H1 and H2 in the scanning region H in addition to a region H0 corresponding to the size L0, the CPU 11 can read the sheet G without image loss, even when the sheet G being conveyed is skewed relative to the conveying direction D2, as in the example of FIG. 8.

Next, the CPU 11 uses the rear sensor 26 to detect the position of the sheet G being conveyed. Specifically, in S6 the CPU 11 determines whether the rear sensor 26 has turned on (i.e., whether the rear sensor 26 has detected the sheet G) and continually repeats this determination while the rear sensor 26 remains off (S6: NO). When the rear sensor 26 is on (S6: YES), in S8 the CPU 11 calculates a first step number ST1. The first step number ST1 denotes the number of steps that the motor M has rotated from the moment the rear sensor 26 turns on until the CPU 11 controls the CIS 24 to begin reading the sheet G. The first step number ST1 is calculated from a first distance differential ΔL1 found by subtracting the leading edge expanded width W1 from a distance L2 between the position P2 and the reading position P1 along the conveying direction D2. Constant Y stands for a forward distance by one step of the pulse signal.

$$\Delta L1 = L2 - W1,\ ST1 = \frac{\Delta L1}{Y}$$

In S10 the CPU 11 waits until the first step number ST1 has been counted after the rear sensor 26 was turned on. In other words, the CPU 11 continually repeats the determination in S10 while the first step number ST1 has not yet been counted (S10: NO). When the first step number ST1 has been reached (S10: YES), in S12 the CPU 11 begins reading the sheet G with the CIS 24. That is, the CPU 11 begins reading the sheet G when the leading edge of the sheet G arrives at a position upstream of the reading position P1 by the leading edge expanded width W1.

At the beginning of this reading operation, the CPU 11 reads a leading edge scanning region SH constituting the leading side of the scanning region H, as shown in FIG. 8. The leading edge scanning region SH has a width SW in the conveying direction D2 that is set to a multiple of the leading edge expanded width W1. Gradation data read in the leading edge scanning region SH includes gradation data for the leading end portion of the sheet G, i.e., the leading end portion of the sheet G that includes the leading edge. In S14 the CPU 11 waits until a third step number ST3 equivalent to the width SW has been counted after the reading operation for the sheet G was initiated. Specifically, the CPU 11 determines in S14 whether the third step number ST3 has been reached and continually repeats the determination while the third step number ST3 has not been reached (S14: NO). When the third step number ST3 has been counted (S14: YES), in S16 the CPU 11 executes a process to calculate a main scan width W0 of the sheet G and an inclination ϕ of the sheet G from gradation data read within the leading edge scanning region SH. Here, conventional methods known in the art may be performed to calculate the main scan width W0 and the inclination ϕ of the sheet G from the gradation data. A detailed description of these methods will not be provided herein.

In S18 the CPU 11 determines the size L0 of the sheet G based on the main scan width W0 calculated in S16. As shown in FIG. 5, a Table T1 is stored in the ROM 12. The Table T1 correlates main scan widths W0 and sizes L0 for standard sizes, such as A4, B5, and the like. Hence, in order to set the size L0 of the sheet G in S18, the CPU 11 references the Table T1 and sets the size L0 to the value associated with the main scan width W0 calculated in S16.

Next, the CPU 11 resets the leading edge expanded width W1 and sets the trailing edge expanded width W2 based on the size L0 set in S18. As shown in FIG. 5, a Table T2 is also stored in the ROM 12. The Table T2 correlates sizes L0 and reference expanded widths WK. In S20 the CPU 11 references the Table T2 stored in the ROM 12 and sets the leading edge expanded width W1 and the trailing edge expanded width W2 to the reference expanded width WK associated with the size L0 calculated in S18.

The reference expanded widths WK correlated with sizes L0 in the Table T2 are set based on the sizes L0 and a critical inclination ϕK for the image-reading device 1 that references the Table T2. The critical inclination ϕK denotes the maximum amount of skew in the sheet G at which the image-processing circuit 17 of the image-reading device 1 can successfully perform a skew correction process on the gradation data. When the inclination ϕ of the sheet G conveyed in the paper-conveying path 22 becomes too large, the sheet cannot pass through the paper-conveying path 22 and becomes jammed in the image-reading device 1. Even if the sheet G is able to pass through the paper-conveying path 22 and the image-reading device 1 is able to read the sheet with the CIS 24, the skew in the gradation data read by the CIS 24 cannot be accurately corrected using the image-processing circuit 17. When the inclination 4) of the sheet G is greater than a unique critical inclination ϕK preset for each individual image-reading device 1, the conveyance of the sheet G is halted, which prevents these problems from occurring.

Next, in S22 the CPU 11 calculates a second step number ST2. The second step number ST2 denotes the number of steps taken after the rear sensor 26 turns off before the CPU 11 stops reading the sheet G with the CIS 24. The second step number ST2 is calculated from a second distance differential AL2 found by subtracting the trailing edge expanded width W2 from the distance L2.

$$\Delta L2 = L2 - W2,\ ST2 = \frac{\Delta L2}{Y}$$

After completing the process to read the leading edge scanning region SH, the CPU 11 continues reading the sheet G for the remaining portion of the scanning region H, while simultaneously monitoring the rear sensor 26. Specifically, in S24 the CPU 11 determines whether the rear sensor 26 has turned off and waits while the rear sensor 26 remains on (S24: NO). When the rear sensor 26 turns off (S24: YES), the CPU 11 waits while simultaneously determining in S26 whether the second step number ST2 has been counted since the rear sensor 26 turned off and in S28 whether the rear sensor 26 has been turned back on by the next sheet G'. If the second step number ST2 is counted before the rear sensor 26 turns back on (S26: YES, S28: NO), in S36 the CPU 11 stops reading the sheet G. In other words, the CPU 11 stops reading the sheet G when the trailing edge of the sheet G reaches a position downstream of the reading position P1 by the trailing edge expanded width W2.

After the CPU 11 has stopped the reading operation for the sheet G, in S38 the CPU 11 executes a skew correction process on the gradation data read in the above reading process using the image-processing circuit 17. In this process, the image-processing circuit 17 extracts gradation data from the gradation data stored in the RAM 13 that corresponds to an original reading region GH in which the sheet G was read. Next, the image-processing circuit 17 corrects the gradation data so that the image formed by the gradation data is rotated an angle equivalent to the inclination ϕ.

After completing the skew correction process, in S40 the CPU 11 determines whether the front sensor 25 is on. If not (S40: NO), the CPU 11 determines that there are no more unprocessed sheets G remaining in the sheet tray 2, stops the operation to convey the sheets G in S42, and ends the reading process. However, if so (S40: YES), the CPU 11 executes the above process on the next sheet G' to be conveyed. That is, in S44 the CPU 11 monitors the rear sensor 26 to detect the position of the next sheet G' being conveyed. More specifically, the CPU 11 determines in S44 whether the rear sensor 26 has turned on and repeats the determination while the rear sensor 26 remains off (S44: NO). When the rear sensor 26 turns on (S44: YES), the CPU 11 repeats the above process from S8.

On the other hand, if the CPU 11 determines in S28 that the rear sensor 26 has turned on before the second step number ST2 was counted (S26: NO, S28: YES), then in S30 the CPU 11 continues to wait until the second step number ST2 has been counted. Once the second step number ST2 has been counted (S30: YES), in S32 the CPU 11 stops reading the sheet G and in S34 executes the skew correction process on the gradation data obtained in the reading operation. After completing the skew correction process, the CPU 11 returns to S8 and executes the process on the next sheet G' being conveyed.

EFFECTS OF THE EMBODIMENT

The image-reading device 1 of the preferred embodiment sets the gap

Z between sheets of the original based on the size L0 and also sets the leading edge expanded width W1 and the trailing edge expanded width W2 based on the size L0. Accordingly, the leading edge expanded width W1 and the trailing edge expanded width W2 can be set based on the size L0 such that the sum WS of these widths is smaller than the gap Z between sheets of the original.

Consider, for example, the case in which the leading edge expanded width W1 and the trailing edge expanded width W2 are set to fixed values independent of the size L0. In this case, the gap Z between sheets of the original becomes wider for larger sizes L0 and is greater than the sum WS of widths when the size L0 is relatively large, as shown in FIG. 8. Accordingly, the scanning regions H on consecutive sheets of an original will not overlap when the image-reading device 1 reads a plurality of the sheets G continuously. Thus, there is no image loss due to overlap in adjacent scanning regions H.

Figure 9A:
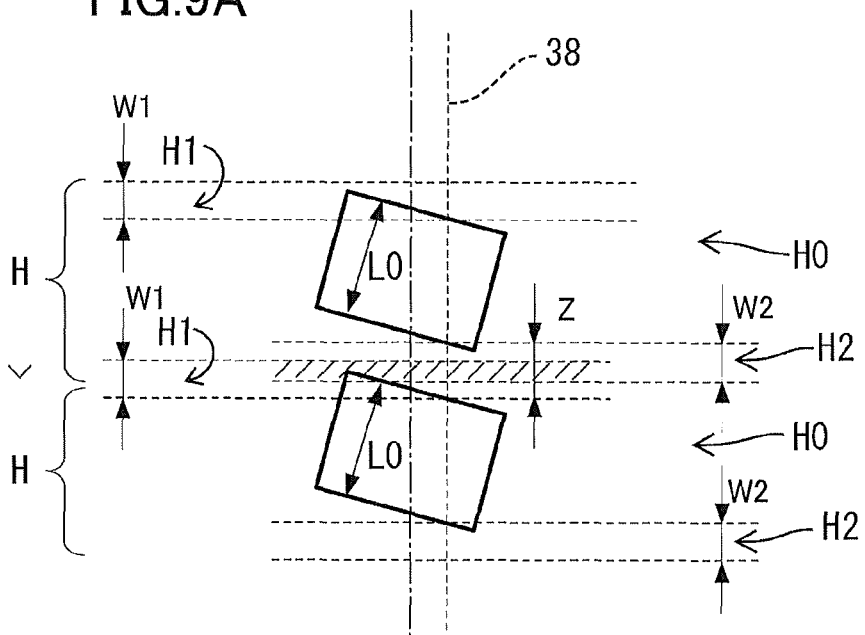
FIG. 9A is a schematic diagram explaining a scanning region and a sheet of original according to a conventional image reading device.
Figure 9B:
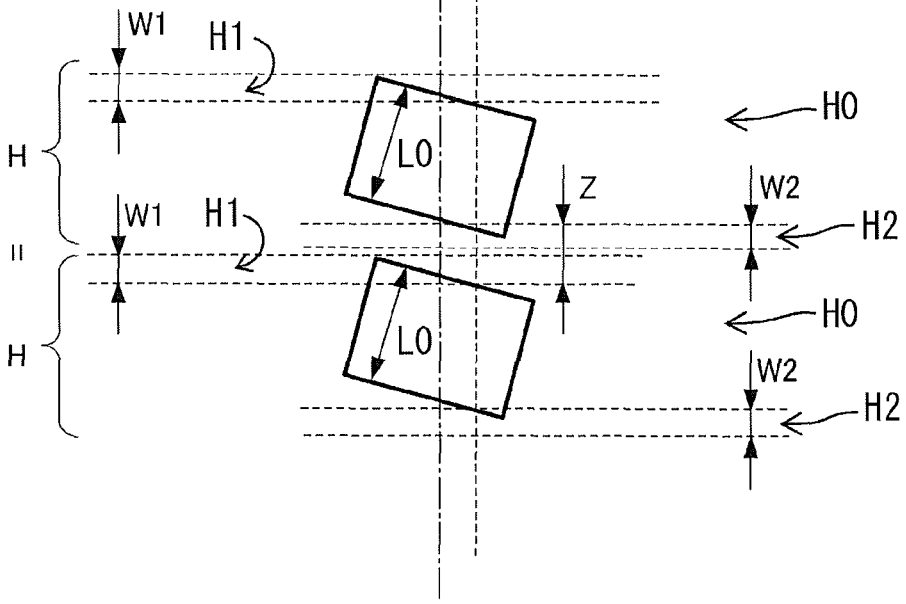
FIG. 9B is a schematic diagram explaining a scanning region and a sheet of original according to the embodiment.

However, the gap Z between sheets of the original becomes narrower for smaller sizes L0 and is smaller than the sum WS when the size L0 is relatively small, as indicated in the top portion of FIG. 9. Consequently, the scanning regions H in consecutive sheets will overlap (the overlapped portion is shaded in FIG. 9) when the image-reading device 1 reads multiple sheets G continuously. As a result, the scanning region H of the next sheet G' is effectively shrunk by an amount equivalent to the overlapping portion of the scanning regions H, leading to image loss in the scanning results for the next sheet G'.

However, the image-reading device 1 according to the preferred embodiment can set the leading edge expanded width W1 and the trailing edge expanded width W2 based on the size L0 so that the sum WS of these widths decreases for smaller sizes L0, thereby maintaining the gap Z between sheets of the original larger than the sum WS regardless of the size L0. Since the amount of the sheet G that extends out of the region H0 for small sizes L0 is also small, the probability of image loss occurring when the leading edge expanded width W1 and the trailing edge expanded width W2 are reduced is not as high as for large sizes L0. Hence, the image-reading device 1 according to the preferred embodiment can suppress image loss when reading the sheet G by setting the gap Z between sheets of the original and the leading edge expanded width W1 and the trailing edge expanded width W2 so that scanning regions H on consecutively conveyed the sheets G do not overlap.

(2) Since the image-reading device 1 of the preferred embodiment sets the size L0 based on gradation data acquired when the CIS 24 actually reads the leading edge scanning region SH of the scanning region H, which includes the leading edge of the sheet G, the image-reading device 1 can set the size L0 accurately. This configuration eliminates the need to provide separate sensors for determining the size L0, thereby reducing manufacturing costs.

(3) The image-reading device 1 of the preferred embodiment sets the leading edge expanded width W1 and the trailing edge expanded width W2 to the reference expanded width WK, which is calculated from the critical inclination ϕK of the image-reading device 1. Therefore, if the sheet G is contained in the scanning region H and does not become jammed in the image-reading device 1, the image-reading device 1 can reliably correct skew in the sheet by processing the gradation data with the image-processing circuit 17.

(4) The Table T2 is stored in the ROM 12 of the image-reading device 1 for correlating sizes L0 with reference expanded widths WK. Hence, the image-reading device 1 selects a reference expanded width WK from the Table T2 based on the size L0 and sets the leading edge expanded width W1 and the trailing edge expanded width W2 to the selected reference expanded width WK. This configuration reduces load on the image-reading device 1 for setting the leading edge expanded width W1 and the trailing edge expanded width W2, making it easy to set the leading edge expanded width W1 and the trailing edge expanded width W2 while reading the sheet G.

VARIATIONS OF THE EMBODIMENT

While the invention has been described in detail with reference to specific embodiment thereof, it would be apparent to those skilled in the art that many modifications and variations may be made therein without departing from the spirit of the invention, the scope of which is defined by the attached claims.

(1) While the present invention is described in the embodiment using the image-reading device 1, the invention is not limited to this embodiment. For example, the present invention may be applied to a multifunction peripheral having at least one of a printer function, a copier function, and a facsimile function for forming images, together with a scanner function.

(2) In the embodiment described above, the image-reading device 1 has a single ASIC 10, and the CPU 11 of the ASIC 10 for executing the reading process. However, the reading process may be executed by a plurality of CPUs, ASICs, and the like, for example. Further, the ASIC 10 in the embodiment includes the image-processing circuit 17 for executing the skew correction process in response to commands from the CPU 11, but the CPU 11 itself may execute the skew correction process.

(3) In the preferred embodiment, the image-reading device 1 continues to read the sheet G after reading the leading edge scanning region SH until the second step number ST2 is counted. However, the image-reading device 1 may instead suspend conveyance and reading of the sheet G during this time when a sheet G of original is skewed greater than the critical inclination ϕK. This method can reduce paper jams that may occur due to continuing conveyance of the sheet G.

(4) In the embodiment described above, the size L0 of the sheet G is set based on the results of reading the sheet G during conveyance, but it is possible to learn the size L0 prior to conveying the sheet G. Even in this case, setting the gap Z between sheets of the original and the leading edge expanded width W1 and the trailing edge expanded width W2 based on the size L0 can reduce image loss when reading the sheet G.

What is claimed is:

1. An image reading device comprising:

a sheet tray configured to load a plurality of sheets each having a leading edge and a trailing edge;

a conveying unit configured to convey the sheet along a conveying path in a conveying direction, the conveying unit comprising:

a feeding roller configured to feed the sheet upon contacting the sheet;

a drive gear configured to drive the feeding roller at a first velocity;

a conveying roller configured to convey the sheet fed by the feeding roller at a second velocity faster than the first velocity;

a drive transmission portion configured to be circularly moved together with the rotation of drive gear; and a drive receiving portion configured to be circularly moved to rotate the feeding roller and be engageable with and disengageable from the drive transmission portion, the drive receiving portion being engaged with the drive transmission portion so as to rotate the feeding roller at the first velocity when the leading edge of the sheet has not reached the conveying roller, and the drive receiving portion being disengaged from the drive transmission portion so as to rotate the feeding roller at the second velocity by following a rotation of the conveying roller through a sheet when the sheet is spanning between the conveying roller and the feeding roller, a period of spanning the sheet between the conveying roller and the feed roller being dependent on a size of the sheet, the circular movement of the drive receiving portion being stopped, despite a continuous rotation of the drive transmission portion, at a timing when the trailing edge of the sheet separates from the feeding roller, and the drive receiving portion catching up with and engaging with the drive transmission portion due to the continuous rotation of the drive transmission portion so as to rotate the feeding roller at the first velocity, the drive transmission portion and the drive receiving portion having an angular positional relationship such that a period from the timing of stopping the drive receiving portion to a timing of the catching up determines a gap between a precedent sheet and a subsequent sheet;

a reading unit provided on the conveying path and configured to read the sheet at a reading position in a main scanning direction orthogonal to the conveying direction;

a detecting unit configured to detect the sheet passing through a position upstream of the reading position; and a control unit configured to control the reading unit to start reading the sheet when the detection unit detects that the leading edge reaches a position upstream of the reading position by a first distance, and the control unit configured to control the reading unit to stop reading the sheet when the detection unit detects that the trailing edge reaches a position downstream of the reading position by a second distance, the first distance and the second distance being determined according to the size of the sheet, wherein the sheet has a leading portion including the leading edge and a main scan width in the main scanning direction, and wherein the control unit comprises:

a first determining part configured to determine the main scan width based on a result of reading the leading portion by the reading unit, and a second determining part configured to determine the size of the sheet based on the determined main scan width.

2. The image reading device according to claim 1, further comprising a correction unit configured to execute a skew correction with respect to a result of reading the sheet, the correction unit having a critical inclination denoting an amount of skew in the sheet capable of executing the skew correction, the control unit being configured to determine the first distance and the second distance based on the size of the sheet and the critical inclination.

3. The image reading device according to claim 1, further comprising a storing unit storing a table in which a co-relation between the size of the sheet and the first and second distances is set.

4. The image reading device according to claim 1, wherein the conveying unit is configured to convey the plurality of sheets with the gap between the precedent sheet and the subsequent sheet, and the control unit is configured to determine the first distance and the second distance such that sum of the first distance and the second distance is smaller than the gap.

5. The image reading device according to claim 4, wherein the gap is determined based on an equation:

$$Z = (\omega 2 - \omega 1) \times (L0 - L1) / \omega 1$$

where Z stands for the gap between the precedent sheet and the subsequent sheet, ω1 stands for an angular velocity of the drive gear, ω2 stands for an angular velocity of the drive receiving portion, L0 stands for a longitudinal length of the sheet in the conveying direction, and L1 stands for a distance from the feeding roller to the conveying roller.

* * * * *